US007384511B2

(12) United States Patent
Mausser et al.

(10) Patent No.: US 7,384,511 B2
(45) Date of Patent: Jun. 10, 2008

(54) DEVICE FOR CHANGING THE CLOTH OF A PAPER MACHINE

(75) Inventors: Wilhelm Mausser, Graz (AT); Gerald Schadler, Vasoldsberg (AT)

(73) Assignee: Andritz AG, Graz (AT)

( * ) Notice: Subject to any disclaimer, the term of this patent is extended or adjusted under 35 U.S.C. 154(b) by 418 days.

(21) Appl. No.: 11/034,331

(22) Filed: Jan. 12, 2005

(65) Prior Publication Data

US 2006/0027351 A1 Feb. 9, 2006

(30) Foreign Application Priority Data

Jan. 13, 2004 (AT) ..... A 29/2004

(51) Int. Cl.
*D21F 1/32* (2006.01)

(52) U.S. Cl. ..... 162/273; 162/274

(58) Field of Classification Search ..... 162/199–200, 162/272–279, 360.2, 360.3; 134/15, 122 R; 15/309.1

See application file for complete search history.

(56) References Cited

U.S. PATENT DOCUMENTS

| | | | | |
|---|---|---|---|---|
| 1,501,179 | A * | 7/1924 | Peacock et al. | 162/279 |
| 2,755,710 | A * | 7/1956 | Beachler | 162/273 |
| 3,989,587 | A * | 11/1976 | Grossmann | 162/200 |
| 4,191,611 | A * | 3/1980 | Rushing et al. | 162/273 |
| 4,608,125 | A * | 8/1986 | Autio | 162/273 |

* cited by examiner

*Primary Examiner*—Eric Hug
(74) *Attorney, Agent, or Firm*—Alix, Yale & Ristas, LLP

(57) ABSTRACT

The invention relates to a device for changing the cloth of a paper machine, particularly a tissue machine, for example a TAD (through-air drying) machine, with a number of deflection rolls (3), (4), (5), (6) and at least one cleaning device (27), (28), (29) for the machine cloth. Levers (9), (20) are provided on either side of the machine cloth (7), where these levers hold at least one deflection roll (3), (4) and can be pivoted from an operating position to a machine cloth changing position. Thus, the time and the number of personnel required to change the machine cloth are reduced substantially.

20 Claims, 1 Drawing Sheet

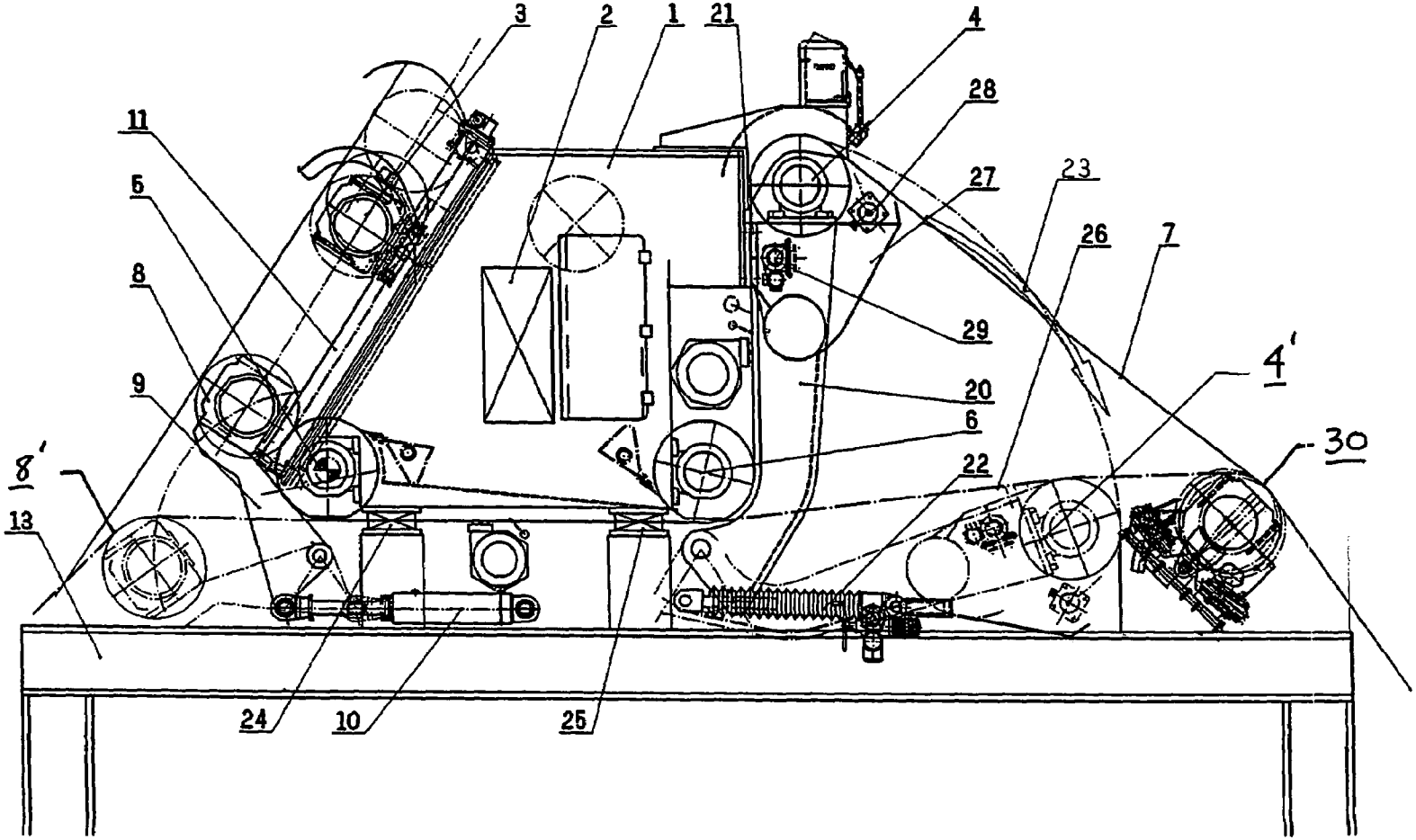
FIG.

DEVICE FOR CHANGING THE CLOTH OF A PAPER MACHINE

BACKGROUND OF THE INVENTION

The invention relates to a device for changing the cloth of a paper machine, particularly a tissue machine, for example a TAD (through-air drying) machine, with a number of deflection rolls and at least one cleaning device for the machine cloth.

The equipment currently used has the disadvantage that changing of the machine cloth takes a long time, is labor-intensive, and requires additional resources, e.g., machine room cranes, which thus are not available for other maintenance work, such as roll changing, routine headbox maintenance, etc., during changing of the machine cloth. The machine cloth of concern here relates to wires, felts, or similar cloth elements.

SUMMARY OF THE INVENTION

The aim of the invention is to simplify changing of machine cloth in such a way that the changing time is shortened, the number of persons required is reduced, and no auxiliary equipment is needed that is not integrated into the machine design.

The invention is characterized by levers being provided, mounted on either side of the machine cloth, where these levers hold at least one deflection roll and can be pivoted from an operating position to a machine cloth changing position. As a result, external lifting gear, such as machine cranes, are no longer needed and can be used for other purposes. In addition, there is no longer any need for the complicated procedure to remove the deflection roll(s), nor to store them outside the machine. This substantially reduces the time required for changing the machine cloth. In addition, the invention considerably improves safety of the operating personnel (no rolls swinging out of the machine).

If the position of the deflection roll(s) for changing machine cloth is such that the cloth can be inserted into the paper machine virtually horizontally, less personnel are required because the cloth no longer has to be pre-folded. This is a particular advantage with the stiff TAD wires.

The invention is used to advantage if the deflection roll is a tensioning roll, where the tensioning roll can be suitable for connecting via the bearing housing to the levers arranged on either side of the machine cloth when the tensioning device is in the final position at zero tension. Using the tensioning roll, the machine cloth can be reduced to zero tension and the lever then used to move the tensioning roll into the machine cloth changing position, at which the machine cloth can be inserted virtually horizontally.

A favorable further development of the invention is characterized by at least two levers mounted on either side of the machine cloth being connected to one another via a shower and water collecting tray, where the shower and water collecting tray and any cleaning showers mounted in it can be pivoted into the machine cloth changing position together with the deflection roll using the levers mounted on either side of the machine cloth. Thus, such machine parts as the shower and water collecting tray and cleaning showers can be lowered together at the same time and need not be dismantled separately for this purpose.

A favorable embodiment of the invention is characterized by the levers being connected to the lifting elements, where the lifting elements can be operated hydraulically, e.g., hydraulic cylinders or electro-mechanical lifting elements, i.e., electrically driven lifting spindles.

Thus in one aspect, the invention is directed to a paper machine having an endless cloth loop for conveying a paper web, a cleaning device supported by a frame for washing the cloth, and at least one cloth deflection roll associated with the cleaning device, wherein the improvement comprises a pair of levers provided on either side of the cloth and attachable to the deflection roll, whereby the deflection roll can be pivoted from an operating position for conveying the cloth through the cleaning device to a retracted position for decreasing the deflection in the cloth to facilitate changing of the cloth.

Preferably, one of the deflection rolls is situated on the upstream side of the cleaning device and another of the deflection rolls is situated on the downstream side of the cleaning device, a pair of levers are provided on either side of the cloth and attachable respectively to each of the deflection rolls, whereby both deflection rolls can be pivoted from an operating position for conveying the cloth through the cleaning device to a retracted position for decreasing the deflection in the cloth to facilitate changing of the cloth. The cloth on the deflection rolls in the retracted positions spans the cleaning device substantially horizontally.

In an especially advantageous embodiment, the upstream roll is attached to a first pair of levers which are connected together by a shower and water collecting tray that is part of the cleaning device, and the downstream roll is a tensioning roll mounted in a bearing housing and translatable in guide blocks oriented obliquely to horizontal, and a second pair of levers is selectively connectable to the bearing housing for removing the tensioning roll from the guide blocks and placing the tensioning roll onto the frame in the retracted position.

BRIEF DESCRIPTION OF THE DRAWINGS

The invention will be described in examples and referring to the drawings, where the FIGURE shows one variant of the invention.

DESCRIPTION OF THE PREFERRED EMBODIMENT

The invention is used in the vicinity of the machine cloth cleaning device 1 in a paper machine, which essentially comprises a cantilevering support structure 2, a tensioning roll 3 for the machine cloth 7, a deflection roll 4, as well as two further guide rolls 5, 6 for the machine cloth, and various cleaning devices, i.e., showers, suction boxes and cleaning doctors.

When threading in new machine cloth 7 with endless woven design, the tensioning roll 3 is run into the shortest tensioning position 8. In this position, two levers 9 on the operating and drive sides of the paper machine are moved up against the roll bearing at roll 3 using an hydraulic cylinder or worm gear screw jacks 10 and bolted to the bearing. After this, the connection between the roll bearing and the guide blocks 11 of the tensioning device is detached. The tensioning roll 3 can now be placed on the machine frame 13, by the pivoting of the levers 9 into a substantially horizontal orientation, as shown at 8'.

Then, the levers 20 that support the deflection roll 4 are detached from the supporting structure 2 on the operating and drive sides by undoing the connections 21 (e.g., bolted connections). After disconnecting all of the showers and suction devices on the drive side, the levers 20 are lowered with the aid of lifting elements 22 in the direction indicated by the arrow 23 onto the machine frame 13 together with the roll 4 and all of the showers and water collecting trays 27 secured to the roll, as shown at 4'.

After placing the two rolls 3 and 4 onto the machine frame 13, the intermediate pieces 24 and 25 in the frame through which the cloth passes are removed from the supporting structure 2 using a cantilever device. The new machine cloth 26 can now be inserted easily, in a virtually horizontal position and without counter-bending, through the openings thus created on the operating side of the machine. In the embodiment shown in the FIGURE, the new cloth 26 deflects slightly on roll 30, but has a clear horizontal opening on the retracted roll at 4', under the rolls 5 and 6, and over roll 3 at position 8', where it is again deflected slightly. The type of roll positioning according to the invention also creates much more excess length in the cloth element, which makes it easier to insert it into the remaining part of the machine. This too causes a reduction in the time required for changing endless woven machine cloths.

The invention claimed is:

1. Device for changing the cloth of a paper machine having an operating side and a drive side with a number of deflection rolls and at least one cleaning device for the machine cloth, wherein the improvement comprises levers provided on the operating and drive sides of the paper machine, where these levers hold at least one deflection roll and can be pivoted from an operating position for deflecting the cloth through the cleaning device to a retracted position for decreasing the deflection in the cloth to facilitate changing of the cloth.

2. Device according to claim 1, wherein the position of the deflection roll(s) for changing the machine cloth creates a space such that the cloth can be inserted into the paper machine substantially horizontally.

3. Device according to claim 1, wherein the deflection roll is a tensioning roll in a tensioning device.

4. Device according to claim 3, wherein the tensioning roll is connectable via a tensioning roll bearing housing to the levers arranged on the operating and drive sides of the paper machine when the tensioning device is in the cloth changing position at zero tension.

5. Device according to claim 1, wherein at least two levers are mounted on either side of the machine cloth and connected to one another via a shower and water collecting tray.

6. Device according to claim 5, wherein the shower and water collecting tray and cleaning showers mounted in the tray pivot together into the machine cloth changing position together with the deflection roll using the levers mounted on the operating and drive sides of the paper machine.

7. Device according to claim 1, wherein the levers are connected to lifting elements.

8. Device according to claim 7, wherein the lifting elements are hydraulic.

9. Device according to claim 7, wherein the lifting elements are electro-mechanical.

10. In a paper machine having an endless cloth loop for conveying a paper web, a cleaning device supported by a machine frame for washing the cloth, and at least one cloth deflection roll associated with the cleaning device, wherein the improvement comprises a pair of levers provided on the operating and drive sides of the paper machine and attachable to said deflection roll, whereby the deflection roll can be pivoted from an operating position for conveying the cloth through the cleaning device to a retracted position for decreasing the deflection in the cloth to facilitate changing of the cloth.

11. The paper machine of claim 10, wherein one of said deflection rolls is situated on the upstream side of the cleaning device and another of said deflection rolls is situated on the downstream side of the cleaning device, a pair of levers are provided on the operating and drive sides of the paper machine and attachable respectively to each of said deflection rolls, whereby both deflection rolls can be pivoted from an operating position for conveying the cloth through the cleaning device to a retracted position for decreasing the deflection in the cloth to facilitate changing of the cloth.

12. The paper machine of claim 11, wherein the cloth on said deflection rolls in the retracted positions spans the cleaning device substantially horizontally.

13. The paper machine of claim 10, wherein the deflection roll is a tensioning roll mounted in a bearing housing and translatable in guide blocks oriented obliquely to horizontal, and said pair of levers is selectively connectable to said bearing housing for removing said tensioning roll from the guide blocks and placing the tensioning roll onto said frame in said retracted position.

14. The paper machine of claim 10, wherein the two levers of a said pair are connected together by a shower and water collecting tray that is part of said cleaning device.

15. The paper machine of claim 14, wherein the shower and water collecting tray includes cleaning showers and the tray with showers is pivotable with the lever into said retracted position.

16. The paper machine of claim 10, wherein the levers are actuated by mechanical advantage lifting elements.

17. The paper machine of claim 16, wherein the lifting elements are hydraulic.

18. The paper machine of claim 16, wherein the lifting elements are electro-mechanical.

19. The paper machine of claim 11, wherein the upstream roll is attached to a first pair of two levers and the levers of said first pair are connected together by a shower and water collecting tray that is part of said cleaning device, and the downstream roll is a tensioning roll mounted in a bearing housing and translatable in guide blocks oriented obliquely to horizontal, and a second pair of said levers is selectively connectable to said bearing housing for removing said tensioning roll from the guide blocks and placing the tensioning roll onto said frame in said retracted position.

20. The paper machine of claim 19, wherein the cloth on said deflection rolls in the retracted positions spans the cleaning device substantially horizontally.

* * * * *